United States Patent [19]

Commerford et al.

[11] 4,003,516

[45] Jan. 18, 1977

[54] ICE CREAM CARTON

[75] Inventors: H. Fred Commerford, Orinda; Arthur C. Dreshfield, Lafayette, both of Calif.; Thomas J. Sellors, Waukegan, Ill.

[73] Assignee: Potlatch Corporation, San Francisco, Calif.

[22] Filed: July 9, 1975

[21] Appl. No.: 594,328

[52] U.S. Cl. ..... 229/51 SC; 229/DIG. 9

[51] Int. Cl.[2] ..... B65D 5/54

[58] Field of Search ..... 229/51 SC, 51 D, 51 R, 229/39

[56] References Cited

UNITED STATES PATENTS

| | | | |
|---|---|---|---|
| 806,230 | 12/1905 | Zahn | 229/DIG. 9 |
| 1,992,222 | 2/1935 | La Grua | 229/51 SC |
| 3,018,941 | 1/1962 | Wagaman | 229/51 SC |
| 3,101,883 | 8/1963 | Gimple | 229/51 SC |
| 3,206,099 | 9/1965 | Fanter et al. | 229/51 SC X |
| 3,219,255 | 11/1965 | Holmes | 229/51 SC X |
| 3,539,093 | 11/1970 | Massengill | 229/DIG. 9 |

*Primary Examiner*—Davis T. Moorhead
*Attorney, Agent, or Firm*—Jack E. Dominik

[57] ABSTRACT

A carton for ice cream, ice milk, sherbet, mellorine and like products is shown, particularly proportioned for a half-gallon capacity having top and bottom panels with a length to width ratio of approximately two to one, preferably this ratio is two to one or greater, front and rear panels having a length to height ratio of more than two to one, and front tear tab opening means which constitute less than ten percent of the perimeter dimension of the carton taken around its width and height. Various embodiments having opposed closure flaps of varying constructions are at each end of the carton ranging from full closure to full closure with a recess for nesting or partial closure with a thumb tab for the same capacity with reduced board usage. The carton blank is susceptible of being manufactured on a milk carton blank machine, and the blank length at any location is held to a maximum of about 15.7 inches. The side seam flap itself is less than ten percent of the total perimeter dimension, and the preferred embodiment is sealed with a line of weakness adjacent the upper edge of the front panel so that upon tearing, the paper is torn from the outer face of the covered portion of the front panel in a strip generally parallel to the upper cut-out portion of the front panel.

5 Claims, 10 Drawing Figures

FIG. 4
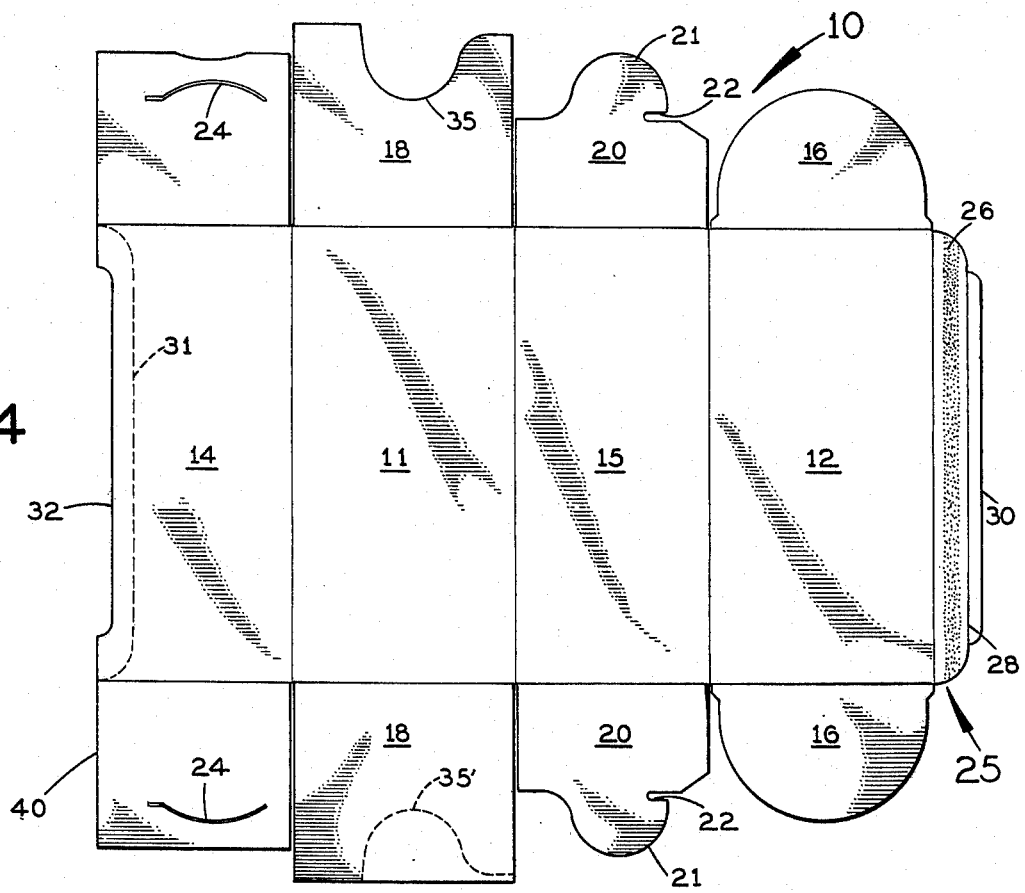
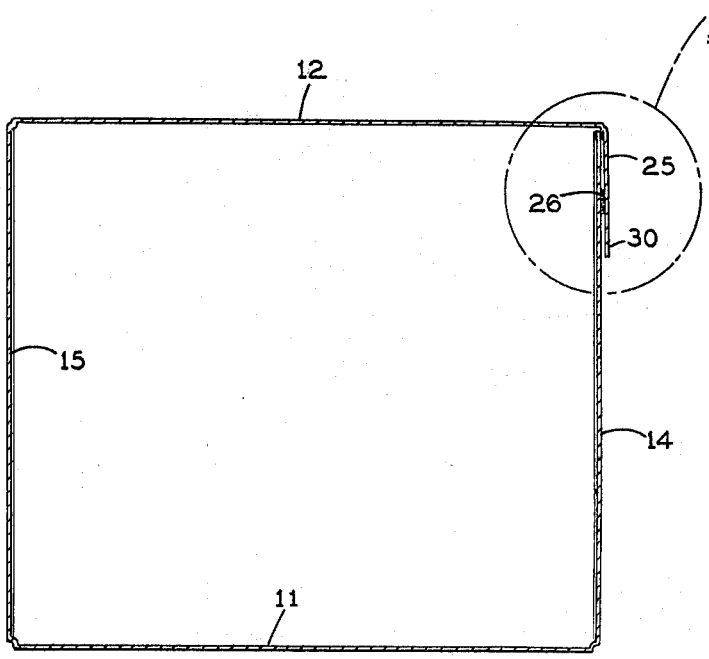
FIG. 5
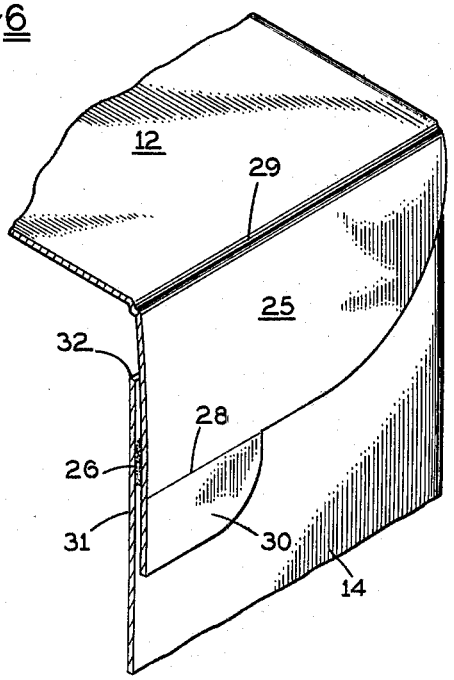
FIG. 6

ICE CREAM CARTON

BACKGROUND OF THE INVENTION

1. Field of Invention

The subject carton for ice cream, ice milk, sherbet, mellorine and like products relates, of course, to the general field of ice cream cartons. It is specific, however, to an ice cream carton which can be produced on a milk carton machine which operates from a continuous web with a high speed rotary printing and rotary cutting.

2. Description Of The Prior Art

Typical ice cream cartons are in almost all super markets. The package is usually susceptible of being opened from the top for ease in scooping out the product. In addition, the ends are usually closed in a fashion that they can be reopened for scraping all of the contents, or alternatively, slicing the ice cream.

In the typical manufacture of the typical prior art carton, rolls of paper board are first cut into large specific sheets. The sheets are then put in precisely piled stacks. The sheets are thereafter passed one or more times through a printing press which applies the desired graphics. Depending upon the facility, the sheets are sometimes stored for quite awhile while each printing pass sets. Sometimes, winding and restacking is required to facilitate ink setting and to provide a suitable pile to feed the cutter.

Thereafter, the printed sheets are scored and cut to the required individual carton size, and superfluous board is stripped from the carton blanks. After stripping, the individual cartons may optionally be coated. Finally, the side seam or glue flap is sealed on a gluer and they are shipped in knock-down fashion to a dairy to erect, fill, and seal.

It will be appreciated that when multiple (e.g., 4, 9, 16) cartons are printed on the sheets just described, a serious marketing planning difficulty is created. A determination is required of the ratio of the many brands, products, and flavors. Consequently, if a particular customer suddenly has a run on one specific product and needs additional cartons for it, he may have to accept production of excess cartons printed for other unneeded flavors or products and store these for uncertain subsequent usage. Alternatively, he may order a more costly special run of just the needed items, but the cost of this is often prohibitive. This is caused by the cost of time, labor, printing plates, ink, and board required to change over the press. This all adds to the cost and difficulties of using the known type of ice cream carton.

On the other hand, milk carton blanks are produced in a single continuous high speed operation from a roll of board in which a web is run through for printing, scoring, cutting and stripping all in precise registration. Only one additional operation is required, in which the side seam is sealed, to have the carton ready to ship in knock-down fashion to a dairy.

The continuous rotary operation on a web enables much higher production rates than the ordinary sheet fed or reciprocating type of carton printing, scoring, and cutting as described with regard to the prior art above. Further, it is much less costly and time-consuming to change this equipment to print different copy. In this environment of the utilization of milk carton machines, the nature of the invention will be better understood as set forth in the summary below.

SUMMARY

The present invention stems from the discovery of precise proportions and sizes and construction of a half-gallon carton for ice cream, ice milk, sherbet, mellorine or similar products which can be run over milk carton machinery at high speed rates, with a high level of precision and with the flexibility of being able to switch from one carton to another on the printing in a very few minutes, thus reducing costs and enabling far better inventory control and response to market developments. The disclosed carton has top and bottom panels with a preferred length to width ratio of approximately two to one or greater. The front and rear panels have a length to height ratio of more than two to one. The ratios on the top and bottom panel may vary along with the front and rear panels so long as the sum of the heights of the front and rear panels and widths of the top and bottom panels is approximately 15 inches. The front closure seal totally constitutes somewhat less than ten percent of the perimeter dimension of the carton taken around its width and height. A portion of this is obtained by nest from the underlapping portion of the cooperating panel, so the net board utilized constitutes less than 5% of the perimeter. Opposed closure flaps at each end are provided, which in one embodiment the inner flap covers the four corners of the end of the tubular interior, and in another embodiment covers less of the interior. The entire carton accommodating a half-gallon in a usable and easily storable rectilinear construction produced from a blank which is less than 15.7 inches long at any point, making it possible to run the same on standard milk carton machinery. The proportions may be varied somewhat to accommodate the metric system; and certain machine modifications may induce minor variations in the 15.7inches limitation. The preferred tear tab opening has a line of weakness adjacent the top panel, and spaced therefrom, so that upon lifting the tear tab, a portion of the paper on the front panel is torn away and yet reclosure can be accomplished with the lift tab itself and its adjacent flap.

In view of the foregoing, it is the primary object of the present invention to provide an ice cream carton which can be produced at high speed and with great efficiency on a milk carton machine. A related advantage is that the customers for milk cartons are dairies which quite often also pack ice cream. Consequently, the marketing and transportation structures for milk cartons and ice cream cartons are closely parallel, so the carton enables further economies and efficiencies there.

Another object of the present invention is to provide a construction of an ice cream carton which, when run in a single web, saves at least three percent and more typically seven percent of material over the prior art; and when run in "two up " nested fasion can save as much as twelve percent in board over the conventional ice cream carton construction.

Still another object of the present invention is to provide an ice cream carton with the advantages and objectives set forth above which is easy to store, easy to handle, easy to open, and easy to reclose.

Yet another object of the present invention is to provide an ice cream carton which, because it can be run through milk carton machinery, is susceptible of printing for a wide variety of styles, customers, flavors, and the like with the down time on change-over of the machinery and printing plates being minimized thereby permitting a scheduling of the carton manufacturing more closely atuned to the marketplace demands of the varying customers as to the particular customer, as well as each customer's particular product at the time.

DESCRIPTION OF THE DRAWINGS

Further objects and advantages of the present invention will become apparent as the following description of illustrative embodiments proceeds taken in conjunction with the accompanying drawings in which:

FIG. 4 is a plan view of the typical blank from which the subject carton is fabricated, shown with the graphic side down.

FIG. 5 is a transverse sectional view taken along section lines 5—5 of FIG. 1.

FIG. 6 is an enlarged cross-sectional view taken on the circled portion marked 6 of FIG. 5 illustrating the cross-section at the side seam.

DESCRIPTION OF A PREFERRED EMBODIMENT

The science of printing and forming milk cartons has advanced to a state of very high efficiency. This has resulted, however, in certain intrinsic limitations. The particular limitation is the repeat length of the printing and cutting patterns which are fixed to the point so that the cutting pattern repeats every 47.1 inches along the web, and the printing pattern repeats every 31.4 inches along the same length. In practice, therefore, the machine is only suitable for the production of blanks which do not exceed 15.7 inches. Otherwise there would be wasted material, and indeed, a high probability of non-registration of printing to the scoring, as well as cutting. Therefore, a critical factor in connection with the present invention was to develop an ice cream carton which would contain one-half a gallon, have acceptable proportions, and most importantly, have a carton blank of 15.7 inches in length. The proportion may be varied somewhat to accommodate the metric system; and certain machine modifications may induce minor variations in the 15.7 inch limitation. Understandably a milk carton has this dimension, but it is totally unsuited for dispensing a solid product such as ice cream.

Figure 1:
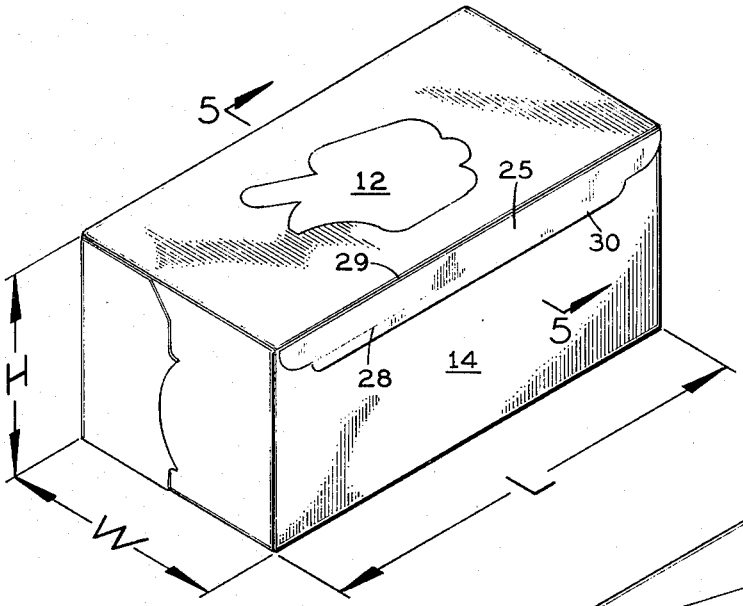
FIG. 1 is a perspective view of a closed ice cream carton illustrative of the present invention indicating its length, width, and height.
Figure 2:
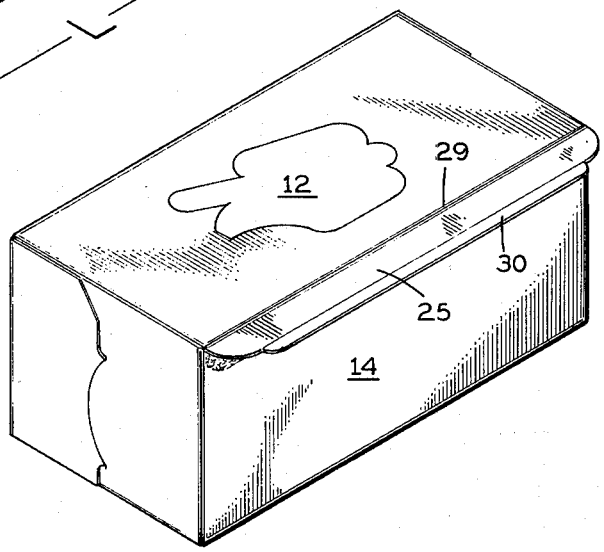
FIG. 2 is a successive view taken from the same vantage point as FIG. 1 illustrating how the illustrative ice cream carton is partially open.
Figure 3:
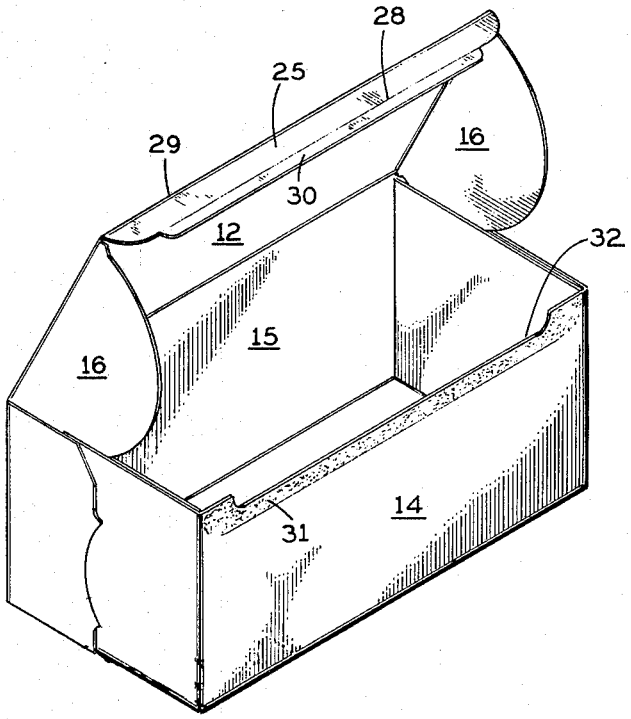
FIG. 3 is a further sequential view of FIG. 2 indicating the carton in its fully open position.

Turning now to the drawings, the convenience of the particular carton will be appreciated as the same is described in its user's environment. As shown in FIG. 1, the length to width ratio (L:W) is approximately two to one, with the top and bottom panels 12 and 11 conforming to this ratio. The front panel 14 and rear panel 15 have a length to height ratio (L:H) of more than two to one. Upon opening the preferred embodiment, as noted in FIG. 2, the user grasps the lift tab 30, and a line of adhesion 26 which is underneath the flap 25, tears a strip of the front panel 14 underneath tear strip recess 32 to a point no further than the tear cut 31. The carton top 12 is then raised by holding on to the lift tab 30 to the configuration shown in FIG. 3. The ice cream contents may then be scooped out, or the end flaps may both be opened and dropped along with the front and rear panels 14, 15, and the entire ice cream contents sliced with a knife or otherwise dispensed for use. While the lift tab 30 construction just described is preferred, other alternatives are available. For example, the opening feature may utilize a line of weakness on the back side of the tear tab, so that fiber is torn from the tab. Or a pair of spaced lines of weakness may be utilized, with fiber torn from between.

For a clearer understanding of the related elements, attention is directed to FIG. 4. In FIG. 4, it will be seen that the ice cream carton 10 is formed from a blank 40. It is formed from top to bottom with a top 12, rear panel 15, body 11, and front panel 14. Each of these four elements are joined by score lines. At the very upper portion, provision is made for a lift tab 30, a lift tab score 28, a flap 25, and a line of adhesion 26; the same being joined by a flap score 29 to the top 12. The tear cut 31, on the graphic side, is shown in phantom lines. At both ends of the top 12 provision is made for top end closure flaps 16 each of which extend from the opposed ends of the top 12. The rear panel 15 has tab end flaps 20 extending from each end; the tab end flaps each terminating in a web 21, having a tab hook 22 at one end portion thereof. The bottom 11 has extending from each end a bottom closure flap 18. A tab nest 35 may be provided in the bottom closure flap 18 in order to receive the tab 21 when the cartons are run two-up which, as will be described hereinafter in connection with the "two-up" web of FIG. 8. Such "two-up" processing achieves a considerable economy in board consumption yet still permits closure at all four corners of the end by the bottom closure flap 18. This nest may be included in the opposed bottom closure flap 18, as shown in phantom lines 35', for uniformity and consistency in adapting the closure equipment to the carton 10.

Finally, the front panel 14 terminates at each with a slot end flap 19, each of the slot end flaps 19 having a tab slot 24 which is crescent-shaped and conformed in order to receive the tab 21 of the tab end flap 20.

Figure 7:
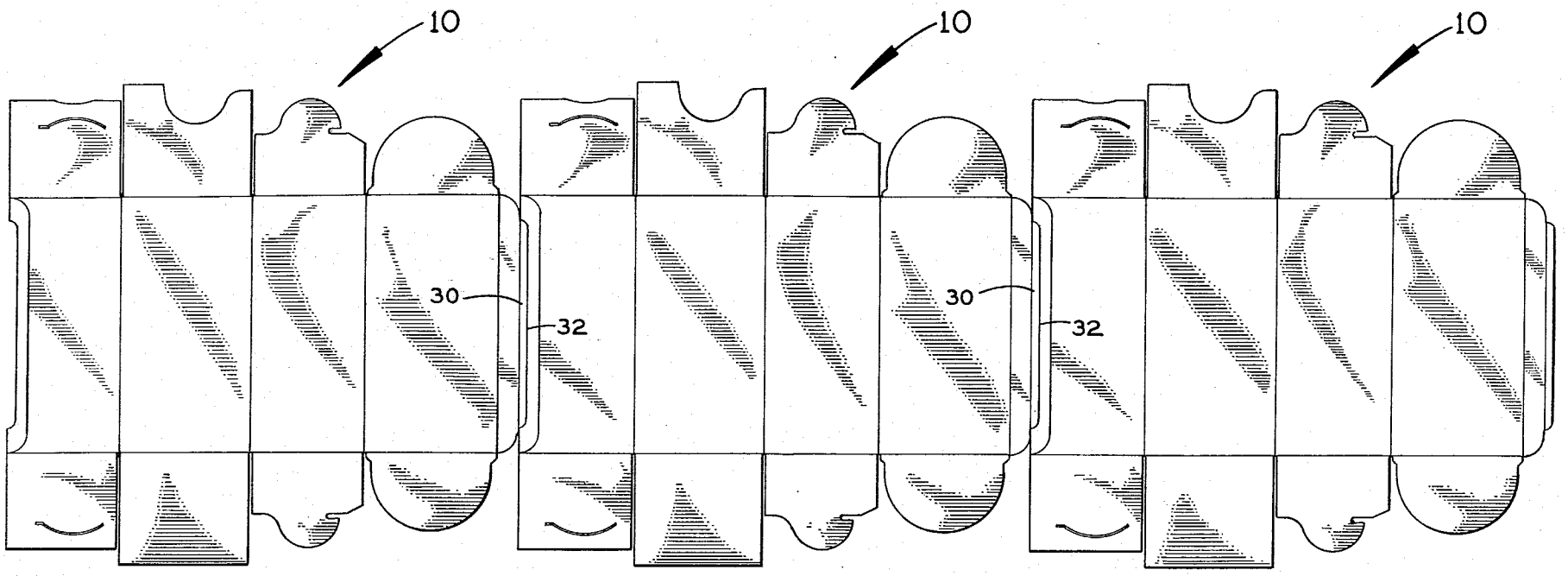
FIG. 7 is an illustrative view of a web for running through the milk carton machine with the patterns on a one-up configuration.
Figure 8:
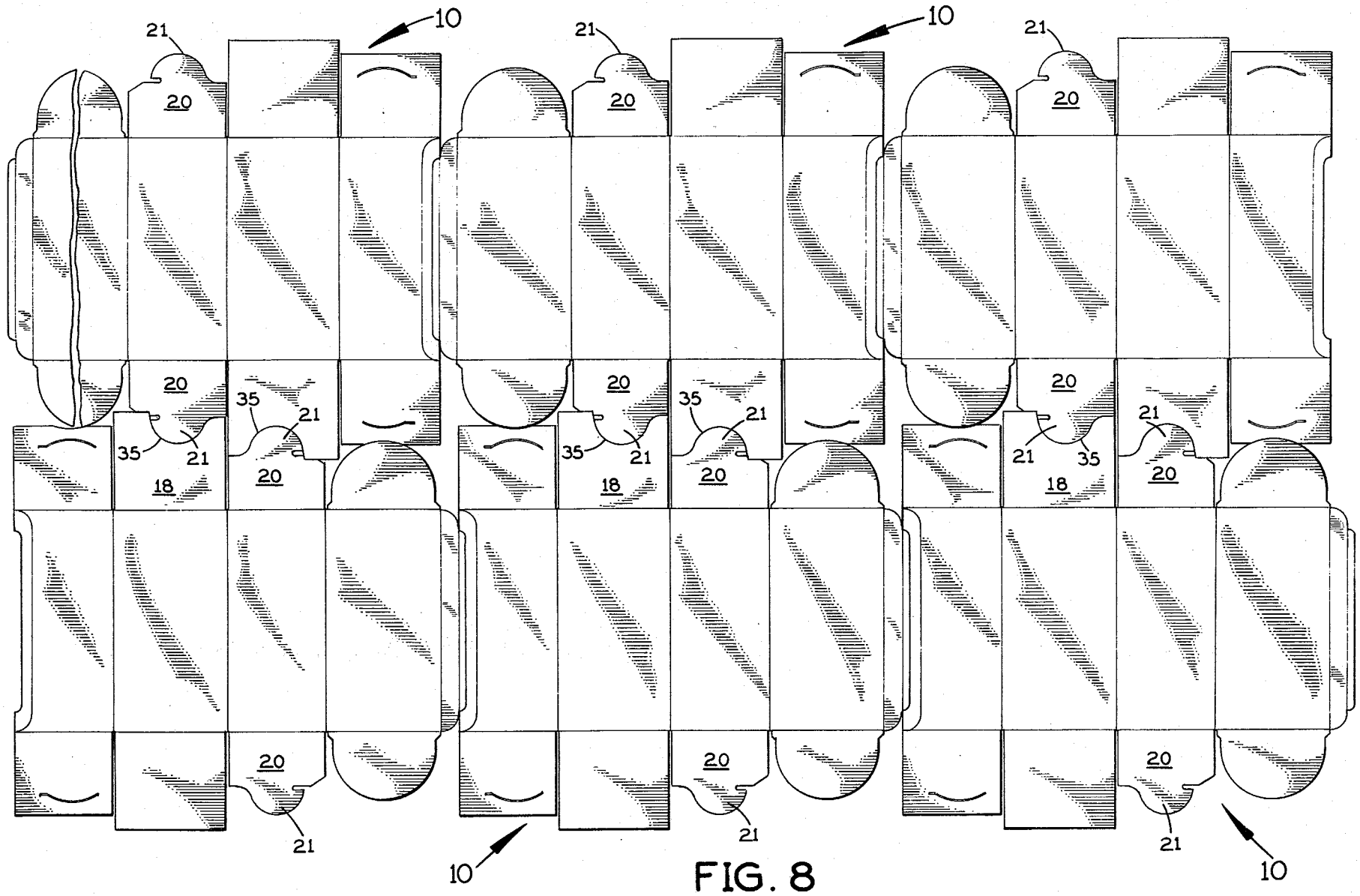
FIG. 8 illustrates how a two-up web can be formed, with the tab of the tab end flap on one carton nesting in a tab nest in the laterally adjacent carton.

The construction of the seal is shown particularly in FIGS. 5, 6, where the relationship between the flap 25 and line of adhesion 26 and the tear cut 31 of the slot side are better shown. Also to be noted is the nesting provision of the lift tab 30 into the tear strip recess 32 when the cartons are run either one-up as shown in FIG. 7, or two-up as shown in FIG. 8. The line of adhesion 26 may be glued, or preferably heat sealed through face-to-face polyethylene coated surfaces.

In the specific embodiment just described, the total distance across the bottom 11 and its two adjacent bottom closure flaps 19 is 15 inches. The bottom dimensions are 8 inches in length, and 4 inches in width. The bottom closure flaps 18 measure 3½ inches in height and 4 inches in width. The rear panel 15 as well as the front panel 14 are both 8 inches long and 3½ inches high. These dimensions are nominal dimensions, but with a total nominal length of the blank of fifteen inches, an additional amount of 0.7 inches are available for the side seam 25 and yet the total carton length does not exceed the critical length of 15.7 inches for efficient printing, cutting, and scoring on a milk carton machine. The total length of flap 25 including tab 30, is greater than 0.7 inches by the amount that tab 30 is nested into recess 32.

Figure 9:
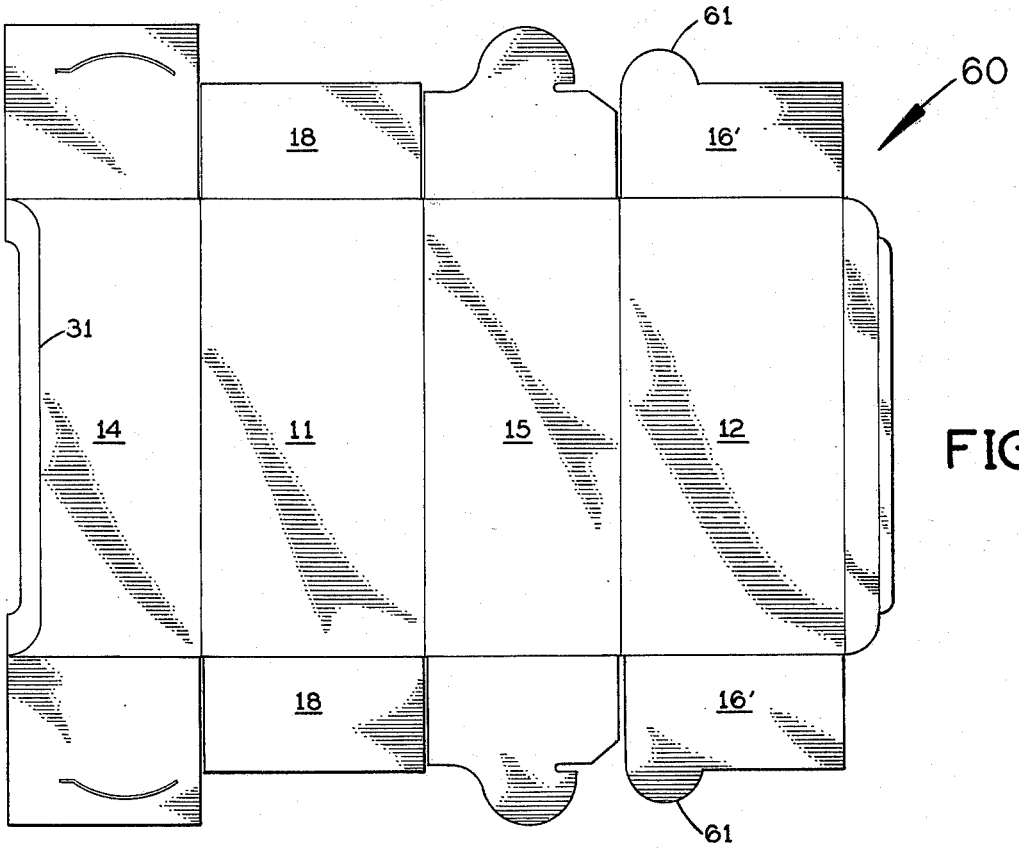
FIG. 9 discloses an ice cream carton blank of an alternative embodiment having a finger tab on one of the end flaps shown graphic side up.
Figure 10:
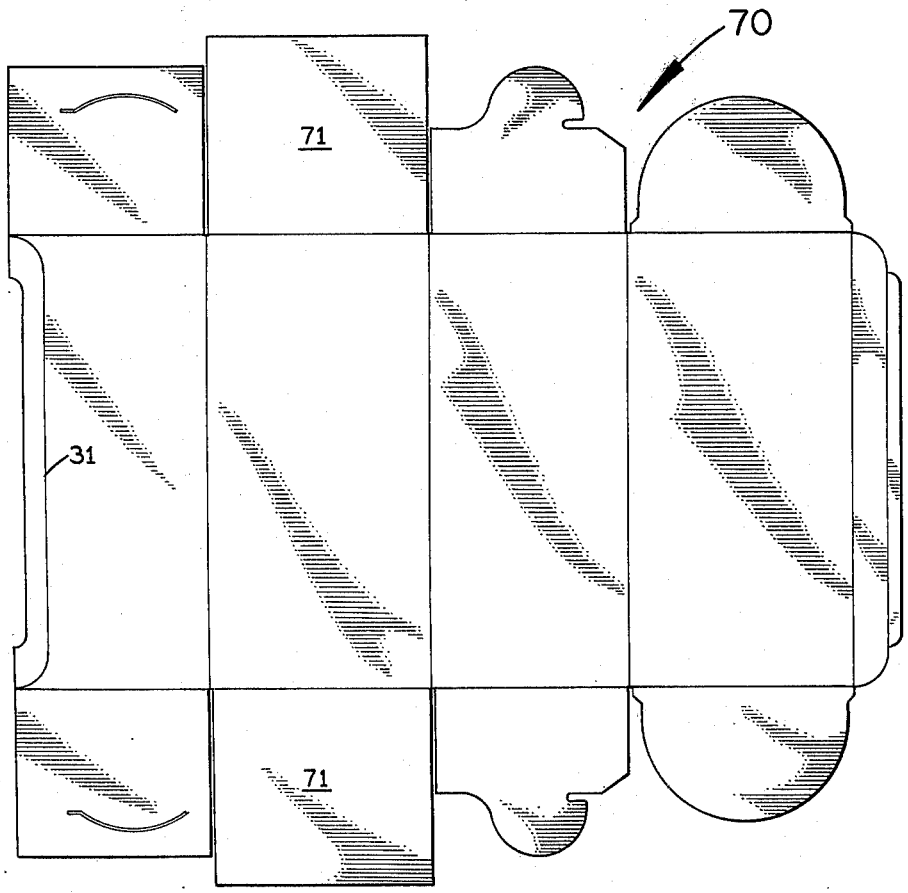
FIG. 10 shows still a further alternative embodiment of the ice cream carton blank showing a full flap with full closure of the end portion shown graphic side up.

Turning now to FIG. 7, it will be seen that when the subject milk carton 10 is run one-up on a web, the principal nesting feature is that between the lift tab 30, and the tear strip recess 32. When the alternative embodiment of blank 60 as shown in FIG. 9 is employed, the maximum lateral dimension across the front panel 14 is 14 inches, as opposed to fifteen inches across the bottom panel 11 and end flaps 18 of blank 40 shown in FIG. 4. Consequently, the finger tab alternative 60 of FIG. 9 having its finger tab 61 on the top end closure flap 16', does not provide for full four corner inner flap closure, but results in a significant saving in board. For those who do not require full inner end flap closure, such as disclosed in the preferred embodiment 10, or even more clearly in the further alternative embodiment 70 of FIG. 10, this saving can prove significant. As shown in FIG. 10, the full end flap model 70 is disclosed in which the full end flaps 71 cover the entire opening defined by the tubular construction of the carton.

The two-up web in FIG. 8 illustrates specifically how the tabs 21 of the tab end flaps 20 nests within the tab nest 35 of the bottom closure flaps 18. The bottom closure flap 18 in each instance covers all four corners of the closure, while with only the tab nest 35 being cut away. In those constructions in which a full closure of the bottom closure flap 18 is not required, the economy is achieved in the two-up web as disclosed in FIG. 8 can run as high as twelve percent over prior art type cartons.

In review, it will be seen that an ice cream carton 10 as well as alternative embodiments 60, and 70 with varying end flap constructions have been shown which can be run on a milk carton machine and achieve great economies. The proportions of the carton are convenient for use, the same can be sealed and easily opened, as well as reclosed with all of the convenience of the pre-existing cartons, but the numerous advantages of speed and production and board economy of the cartons illustrative of the present invention.

Although particular embodiments of the invention have been shown and described in full here, there is no intention to thereby limit the invention to the details of such embodiments. On the contrary, the invention is to cover all modifications, alternatives, embodiments, usages and equivalents of an ice cream carton as fall within the spirit and scope of the invention, specification, and the appended claims.

What is claimed is:

1. A half-gallon carton comprising, in combination, top and bottom panels having a length to width ratio of approximately two to one, or more, front and rear panels having a length to height ratio of at least two to one, front opening and reclosure means comprising less than 10 percent of the perimeter dimension of said carton taken around its width and height, opposed closure flaps at each end which together substantially cover the end of the tubular interior defined by the top, bottom, front and rear panels, the whole defining a carton having a perimeter dimension taken around its width and height of less than about 15.7 inches, and produced from a blank which is less than about 15.7 inches long at any point across its width.

2. In the half-gallon carton of claim 1 above, said end closure flaps including, a tab nest recess in the first to close end closure flaps which, when the cartons are run two-up on a web, is complimentary in configuration to the tab extending from the tab end flap.

3. A half-gallon carton comprising, in combination, top and bottom panels each having a length and width, front and rear panels having a length to height ratio of at least two to one, the sum of the widths of the top and bottom panels plus the heights of the front and rear panels being approximately 15 inches, front opening and reclosure means comprising less than 10 percent of the perimeter dimension of said carton taken around its width and height, opposed closure flaps at each end which together substantially cover the end of the tubular interior defined by the top, bottom, front and rear panels, the whole defining a carton having a perimeter dimension taken around its width and height of less than about 15.7 inches, and produced from a blank which is less than about 15.7 inches long at any point across its width.

4. In the half-gallon carton of claim 3 above, said front panel having a line of weakness extending substantially across the upper portion of the front panel and on the outside thereof terminating closely adjacent to the ends of front panel, and the overlap flap secured to the face of the front panel above the line of weakness.

5. A half gallon carton blank formed from a continuous web of board on a rotary die and press suitable for the manufacture of milk cartons comprising, in combination, top and bottom panels each having a length and width, front and rear panels having a length to height ratio of at least two to one, the sum of the widths of the top and bottom panels plus the heights of the front and rear panels being approximately 15 inches, front opening and reclosure means comprising less than ten per cent of the perimeter dimension of said carton taken around its width and height, opposed closure flaps at each end which together substantially cover the end of the tubular interior defined by the top, bottom, front and rear panels, the subject blank being capable of forming into a carton having a perimeter dimension taken around its width and height of less than about 15.7 inches, and produced from a blank which is less than about 15.7 inches long at any point across its width.

* * * * *

UNITED STATES PATENT OFFICE

CERTIFICATE OF CORRECTION

Patent No. 4,003,516 Dated January 18, 1977

Inventor(s) H. Fred Commerford, et al

It is certified that error appears in the above-identified patent and that said Letters Patent are hereby corrected as shown below:

The cover sheet should be deleted and substituted with the attached sheet therefore.

Signed and Sealed this

Tenth Day of May 1977

[SEAL]

*Attest:*

RUTH C. MASON
*Attesting Officer*

C. MARSHALL DANN
*Commissioner of Patents and Trademarks*

United States Patent [19]

Commerford et al.

[11] 4,003,516

[45] Jan. 18, 1977

[54] ICE CREAM CARTON

[75] Inventors: H. Fred Commerford, Orinda; Arthur C. Dreshfield, Lafayette, both of Calif.; Thomas J. Sellors, Waukegan, Ill.

[73] Assignee: Potlatch Corporation, San Francisco, Calif.

[22] Filed: July 9, 1975

[21] Appl. No.: 594,328

[52] U.S. Cl. ..... 229/51 SC; 229/DIG. 9

[51] Int. Cl.[2] ..... B65D 5/54

[58] Field of Search ..... 229/51 SC, 51 D, 51 R, 229/39

[56] References Cited

UNITED STATES PATENTS

| | | | |
|---|---|---|---|
| 806,230 | 12/1905 | Zahn | 229/DIG. 9 |
| 1,992,222 | 2/1935 | La Grua | 229/51 SC |
| 3,018,941 | 1/1962 | Wagaman | 229/51 SC |
| 3,101,883 | 8/1963 | Gimple | 229/51 SC |
| 3,206,099 | 9/1965 | Fanter et al. | 229/51 SC X |
| 3,219,255 | 11/1965 | Holmes | 229/51 SC X |
| 3,539,093 | 11/1970 | Massengill | 229/DIG. 9 |

*Primary Examiner*—Davis T. Moorhead
*Attorney, Agent, or Firm*—Jack E. Dominik

[57] ABSTRACT

A carton for ice cream, ice milk, sherbet, mellorine and like products is shown, particularly proportioned for a half-gallon capacity having top and bottom panels with a length to width ratio of approximately two to one, preferably this ratio is two to one or greater, front and rear panels having a length to height ratio of more than two to one, and front tear tab opening means which constitute less than ten percent of the perimeter dimension of the carton taken around its width and height. Various embodiments having opposed closure flaps of varying constructions are at each end of the carton ranging from full closure to full closure with a recess for nesting or partial closure with a thumb tab for the same capacity with reduced board usage. The carton blank is susceptible of being manufactured on a milk carton blank machine, and the blank length at any location is held to a maximum of about 15.7 inches. The side seam flap itself is less than ten percent of the total perimeter dimension, and the preferred embodiment is sealed with a line of weakness adjacent the upper edge of the front panel so that upon tearing, the paper is torn from the outer face of the covered portion of the front panel in a strip generally parallel to the upper cut-out portion of the front panel.

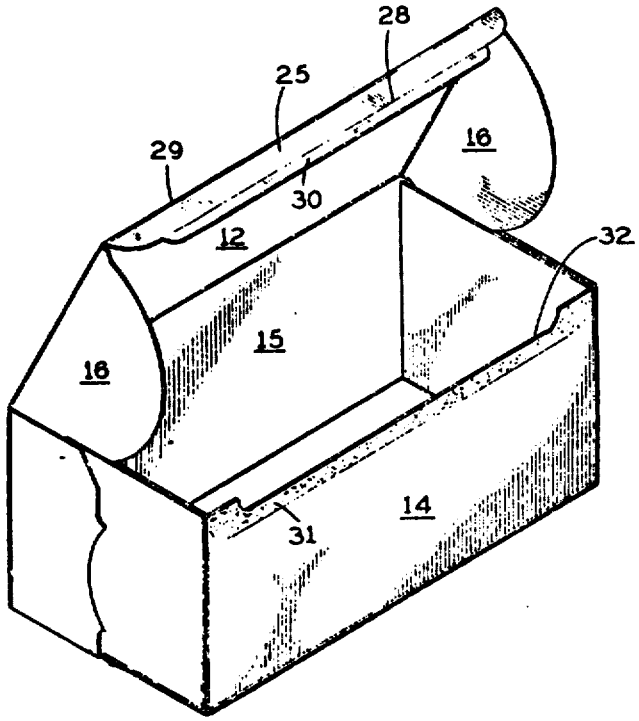

5 Claims, 10 Drawing Figures